US007144176B2

(12) United States Patent
Lin

(10) Patent No.: US 7,144,176 B2
(45) Date of Patent: Dec. 5, 2006

(54) INK RESERVOIR FOR ATTACHING TO VARIOUS PENS

(76) Inventor: Chia Hsiung Lin, P.O.Box 10-69, Chong Ho, Taipei (TW) 235

( * ) Notice: Subject to any disclaimer, the term of this patent is extended or adjusted under 35 U.S.C. 154(b) by 316 days.

(21) Appl. No.: 10/798,542

(22) Filed: Mar. 9, 2004

(65) Prior Publication Data

US 2005/0201816 A1 Sep. 15, 2005

(51) Int. Cl.
*B43K 5/00* (2006.01)
*B43K 7/10* (2006.01)

(52) U.S. Cl. ..... 401/221; 401/216

(58) Field of Classification Search ..... 401/199, 401/209, 216, 221
See application file for complete search history.

(56) References Cited

U.S. PATENT DOCUMENTS 2,646,761 A * 7/1953 Knobel ..... 29/441.1
3,205,863 A * 9/1965 Rhoades ..... 401/111
5,336,009 A * 8/1994 Young ..... 401/209
5,735,592 A 4/1998 Shu ..... 362/118
5,929,135 A * 7/1999 Wasai et al. ..... 523/161
5,984,559 A * 11/1999 Shiobara et al. ..... 401/214
6,129,473 A 10/2000 Shu ..... 401/195
6,602,011 B1 * 8/2003 Tanaka ..... 401/214

FOREIGN PATENT DOCUMENTS

EP 252694 A1 * 1/1988

OTHER PUBLICATIONS

Shu (US 2002/0089846A1), "Doube-Tube Water Pen", Jul. 11, 2002.

* cited by examiner

*Primary Examiner*—Tuan Nguyen

(57) ABSTRACT

A pen includes a housing, and an ink reservoir to be received in the housing. The ink reservoir includes a cartridge received in the housing and for receiving ink, a barrel attaching to front of the cartridge, and a nib attached to the barrel, for extending out through the front opening of the housing. The provision of the barrel between the cartridge and the nib allows the ink reservoir to be accommodated into various housings of different lengths and of different structures. The barrel includes a peripheral rib extended from a peripheral swelling for engaging with a spring member which may bias the barrel against the housing.

2 Claims, 8 Drawing Sheets

INK RESERVOIR FOR ATTACHING TO VARIOUS PENS

BACKGROUND OF THE INVENTION

1. Field of the Invention

The present invention relates to an ink reservoir, and more particularly to an ink reservoir having a structure for attaching to various pens of different configurations.

2. Description of the Prior Art

Typical ink reservoirs comprise a nib attached to one end of a cartridge for writing purposes. Normally, the typical pens comprise a housing having a longitudinal chamber formed therein to receive the ink reservoirs. Conventionally, the housing includes a tip having a predetermined size or diameter to snugly receive the nib of the ink reservoirs, such that the ink reservoirs may only be attached to the housings having the corresponding and predetermined structures.

For example, U.S. Pat. No. 5,735,592 to Shu discloses one of the typical pens including an ink reservoir slidably received in a housing, and having a pair of nips formed thereon for engaging with spring members. The other ink reservoirs that have no nips formed or provided thereon may not be attached to the pen of Shu.

U.S. Pat. No. 6,129,473 to Shu discloses another typical pen including an ink reservoir stably received and retained in a housing. The ink reservoir includes a predetermined structure and may only be retained in the housing as disclosed in U.S. Pat. No. 6,129,473 to Shu, but may not be attached to the housing as disclosed in U.S. Pat. No. 5,735,592 to Shu.

U.S. Patent Application Publication No. US 2002/0089846 A1 to Shu discloses a further typical pen also including an ink reservoir stably received and retained in a housing. The ink reservoir also includes a predetermined structure or length and may only be retained in the housing as disclosed in U.S. Patent Application Publication No. US 2002/0089846 A1 to Shu, but may not be attached to the housing of the other pens.

The present invention has arisen to mitigate and/or obviate the afore-described disadvantages of the conventional ink reservoirs.

SUMMARY OF THE INVENTION

The primary objective of the present invention is to provide an ink reservoir including a structure for attaching to various pens of different configurations.

In accordance with one aspect of the invention, there is provided a pen comprising a housing including a front opening formed therein, and an ink reservoir including a cartridge received in the housing, and provided for receiving ink therein, a barrel attaching to front of the cartridge, and a nib attached to the barrel, for extending out through the front opening of the housing. The provision of the barrel between the cartridge and the nib allows the ink reservoir to be accommodated into various housings of different lengths and of different configurations The barrel includes a peripheral swelling extended radially and outwardly therefrom, and having an outer diameter equals to an inner diameter of the cartridge, to allow the peripheral swelling of the barrel to be engaged into the cartridge.

The barrel includes a peripheral rib extended radially and outwardly from the peripheral swelling, to engage with the cartridge, and to limit an engagement of the barrel relative to the cartridge, and to prevent the barrel from being over engaged into the cartridge.

The barrel includes at least one sealing ring provided thereon and engaged between the peripheral swelling of the barrel and the cartridge, to prevent ink from flowing out through a gap defined between the peripheral swelling of the barrel and the cartridge.

A spring member may further be provided and engaged between the housing and the barrel, to apply a spring biasing force against the barrel of the ink reservoir. The spring member may be engaged with the peripheral rib of the barrel.

The barrel includes a tube extended therefrom and having an inner diameter arranged to receive the nib therein. The tube includes an outer diameter smaller than that of the barrel, to form a peripheral shoulder between the tube and the barrel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1A:
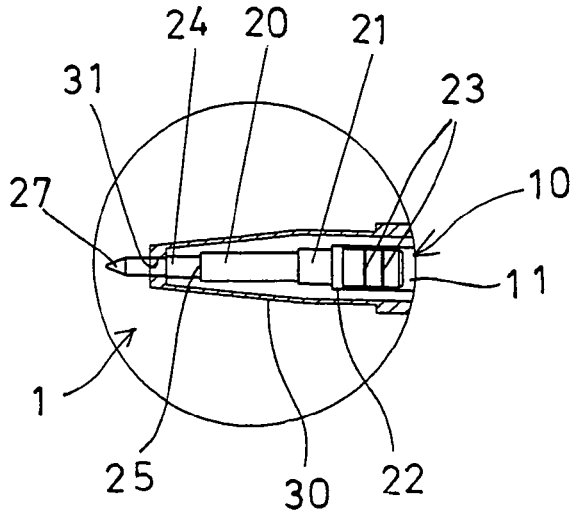
FIG. 1A is an enlarged partial cross sectional view of the pen as shown in FIG. 1.

Referring to the drawings, and initially to FIGS. 1, 1A, and 2–4, a pen 1 in accordance with the present invention comprises an ink reservoir 10, and a housing 30 (FIGS. 1, 1A) for receiving the ink reservoir 10 therein. The ink reservoir 10 in accordance with the present invention is provided for selectively attaching to various housings 30 (FIGS. 1, 1A), 50 (FIGS. 5, 5A–5D), 60 (FIGS. 6, 6A–6D), and 70 (FIGS. 7, 7A–7D).

Figure 3:
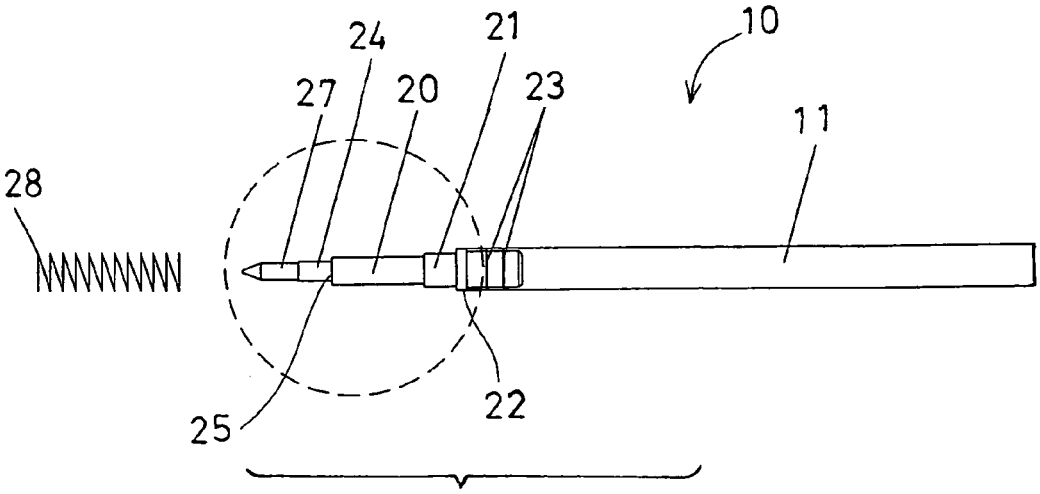
FIG. 3 is a partial exploded view of the ink reservoir.
Figure 4:
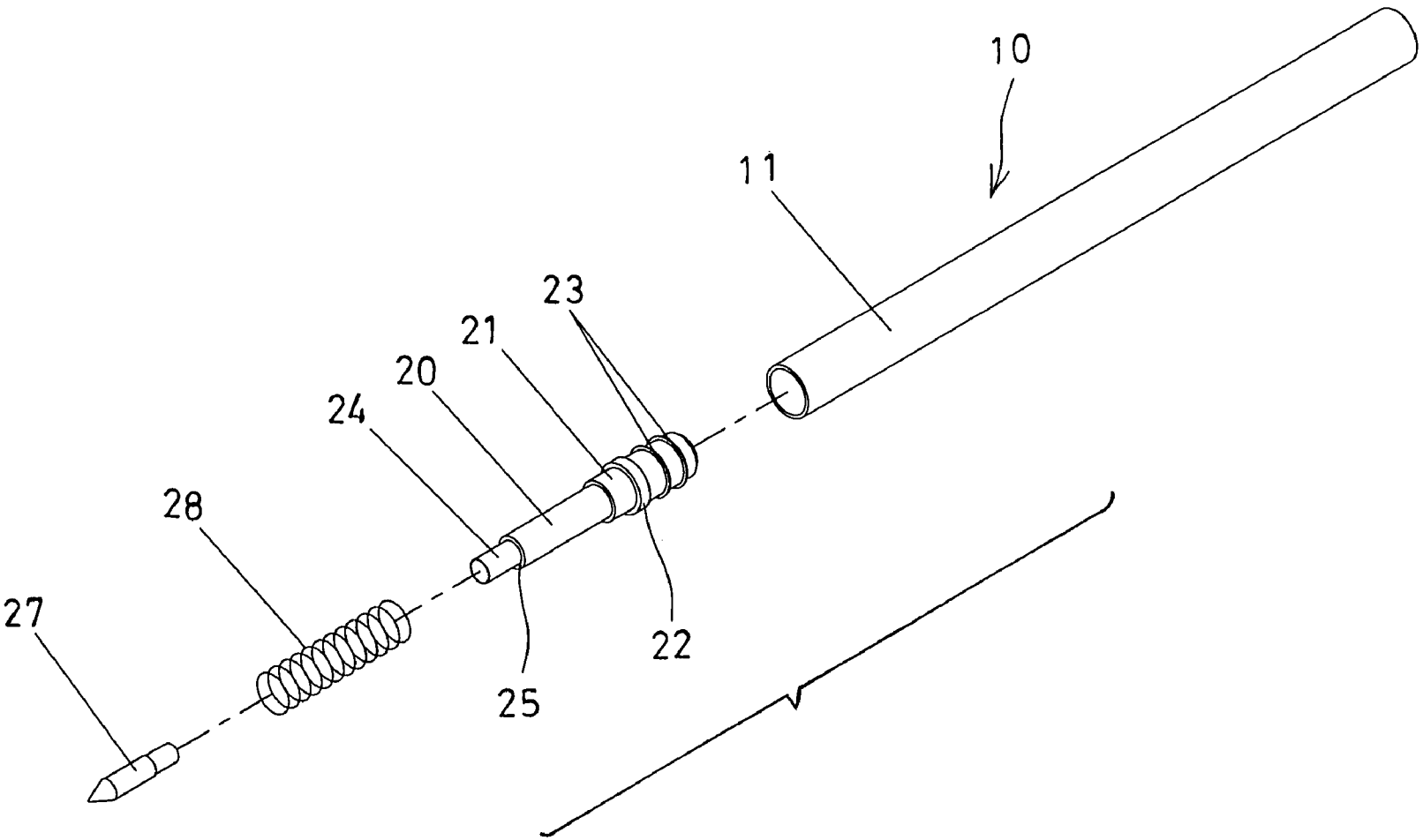
FIG. 4 is another partial exploded view of the ink reservoir.
Figure 5C:
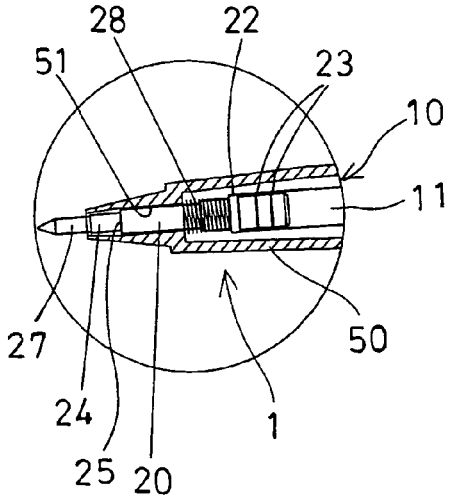
FIGS. 5C, 5D are partial cross sectional views illustrating the attachment of the ink reservoir to the pens as shown in FIGS. 5A and 5B respectively.
Figure 5A:
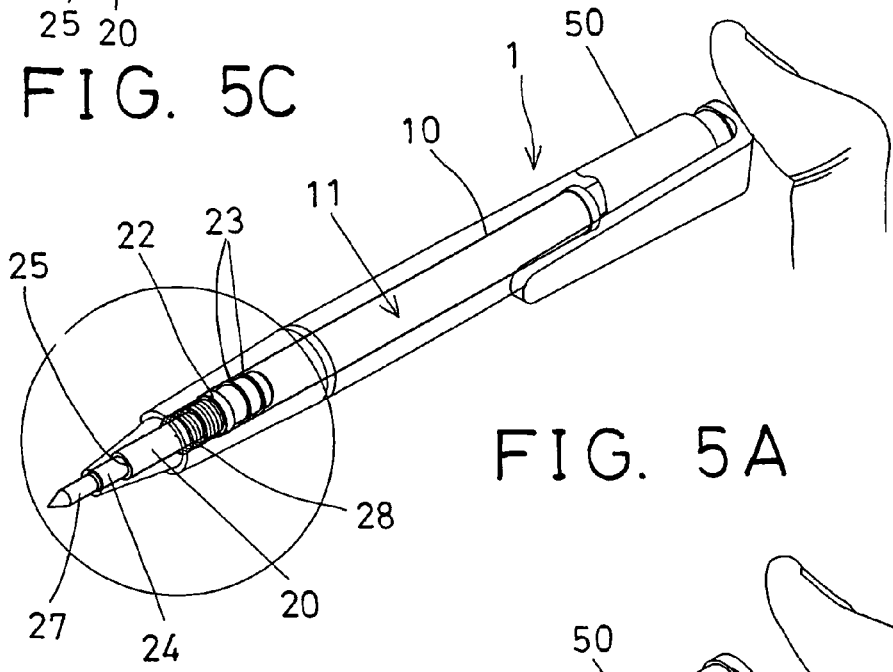
FIGS. 5A, 5B are perspective views illustrating the operation of the ink reservoir in the pen as shown in FIG. 5.
Figure 5:
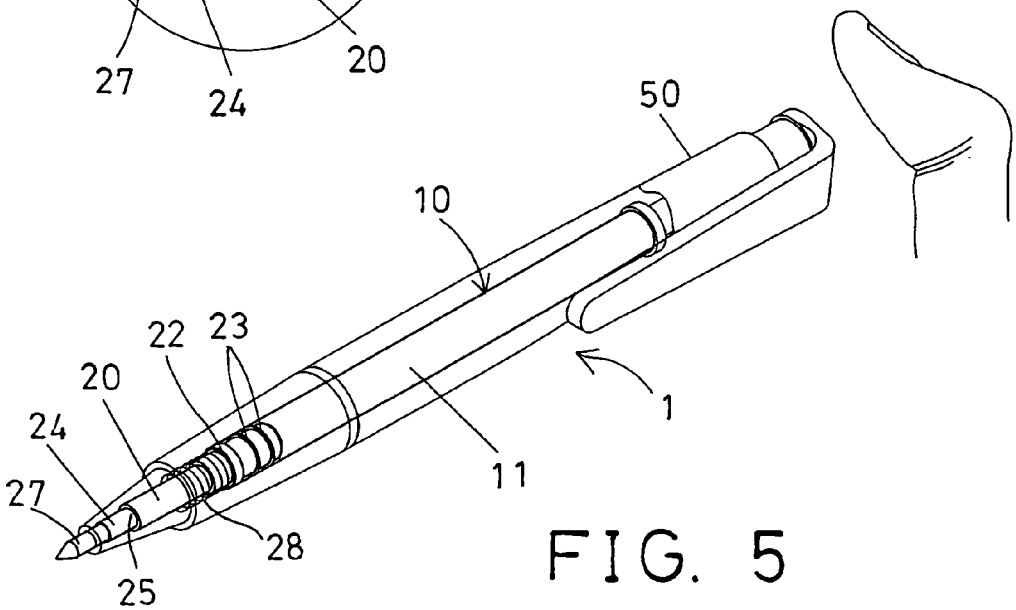
FIG. 5 is a perspective view illustrating another pen having the ink reservoir selectively or changeably received therein.
Figure 6D:
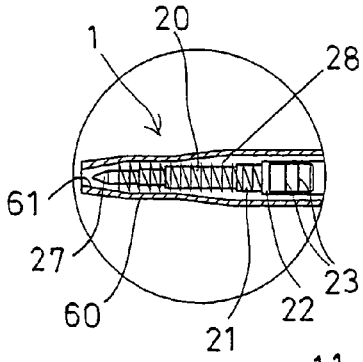
FIGS. 6C, 6D are partial cross sectional views illustrating the attachment of the ink reservoir to the pens as shown in FIGS. 6A and 6B respectively.
Figure 6B:
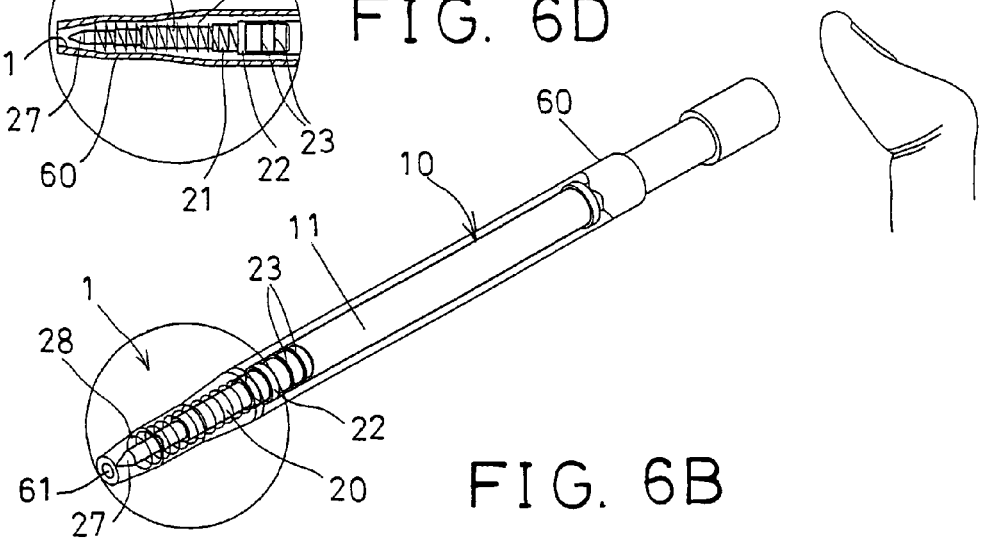
FIGS. 6A, 6B are perspective views illustrating the operation of the ink reservoir in the pen as shown in FIG. 6.
Figure 5D:
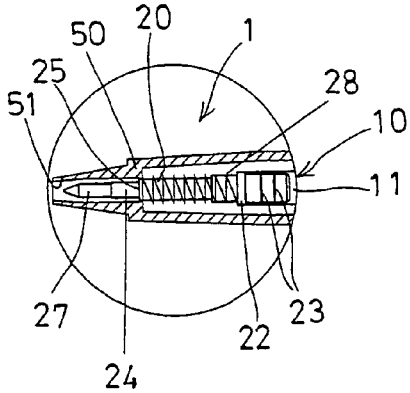
Figure 5B:
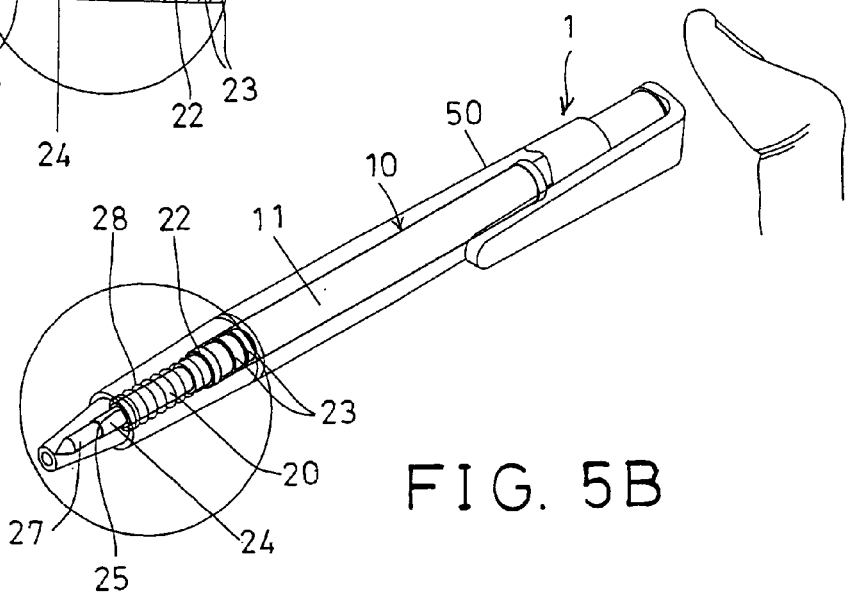
Figure 6C:
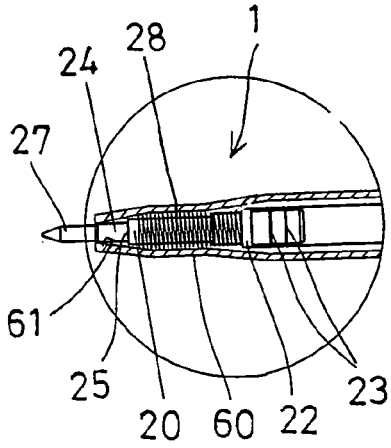
Figure 6A:
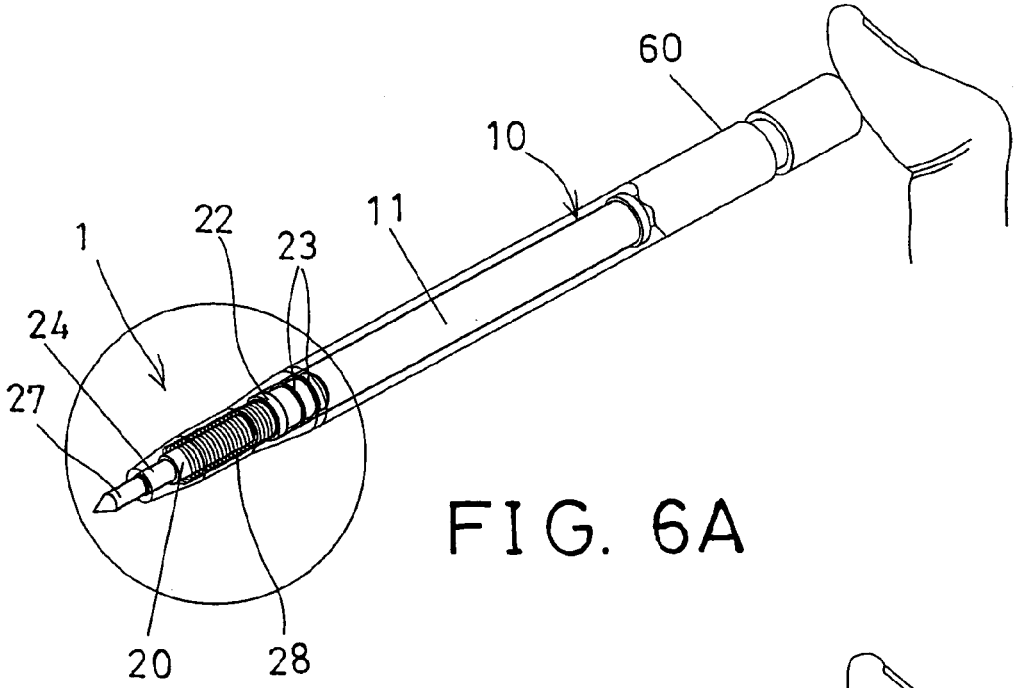
Figure 6:
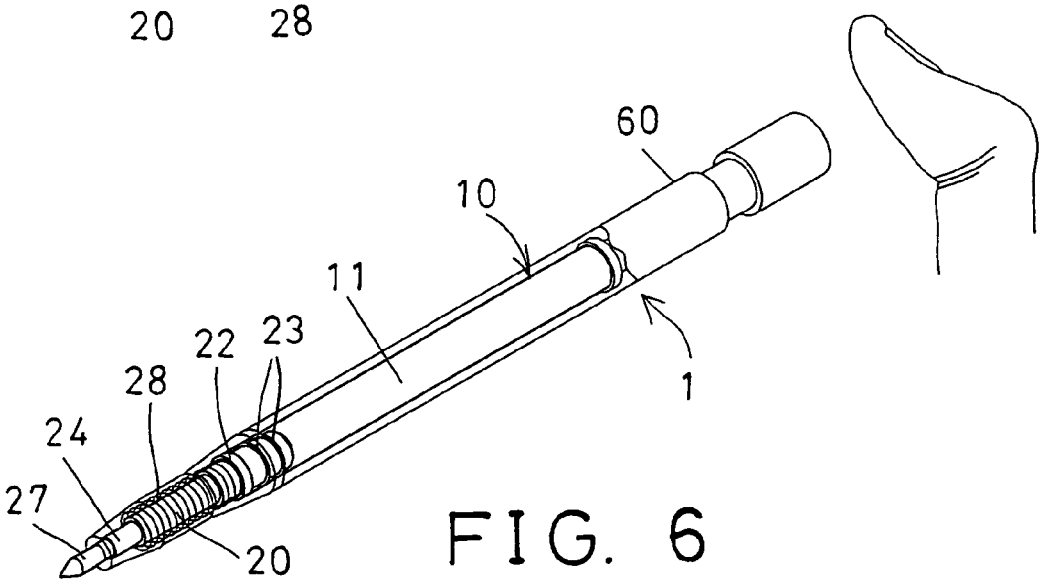
FIG. 6 is another perspective view similar to FIGS. 1 and 5, illustrating the other pen having the ink reservoir selectively or changeably received therein.

The ink reservoir 10 includes a cartridge 11 for receiving ink therein, a barrel 20 attaching to front portion of the cartridge 11, and a nib 27 for attaching to the barrel 20 and for extending out through a front opening 31, 51, 61, 71 of the housing 30, 50, 60, 70. For example, the barrel 20 includes a peripheral swelling 21 extended radially and outwardly from one end, such as the rear portion thereof, and preferably having an outer diameter equals to the inner diameter of the cartridge 11, for being engaged into the cartridge 11 (FIGS. 1A, 3).

It is preferable that the barrel 20 includes a peripheral rib 22 extended radially and outwardly from the peripheral swelling 21 thereof, to engage with the cartridge 11, and to limit the engagement of the barrel 20 relative to the cartridge 11, and to prevent the barrel 20 from being over engaged into the cartridge 11. One or more sealing rings 23 may further be provided and engaged between the barrel 20 and the cartridge 11, to prevent ink from flowing out through the gap defined between the barrel 20 and the cartridge 11.

The barrel 20 further includes a tube 24 extended forwardly therefrom, in which the tube 24 includes an outer diameter smaller than that of the barrel 20, to form or define a peripheral shoulder 25 between the tube 24 and the barrel 20. The tube 24 includes an inner diameter arranged to snugly receive a typical nib 27 therein. Accordingly, the nib 27 may be indirectly attached to the cartridge 11 with the barrel 20.

Figure 1:
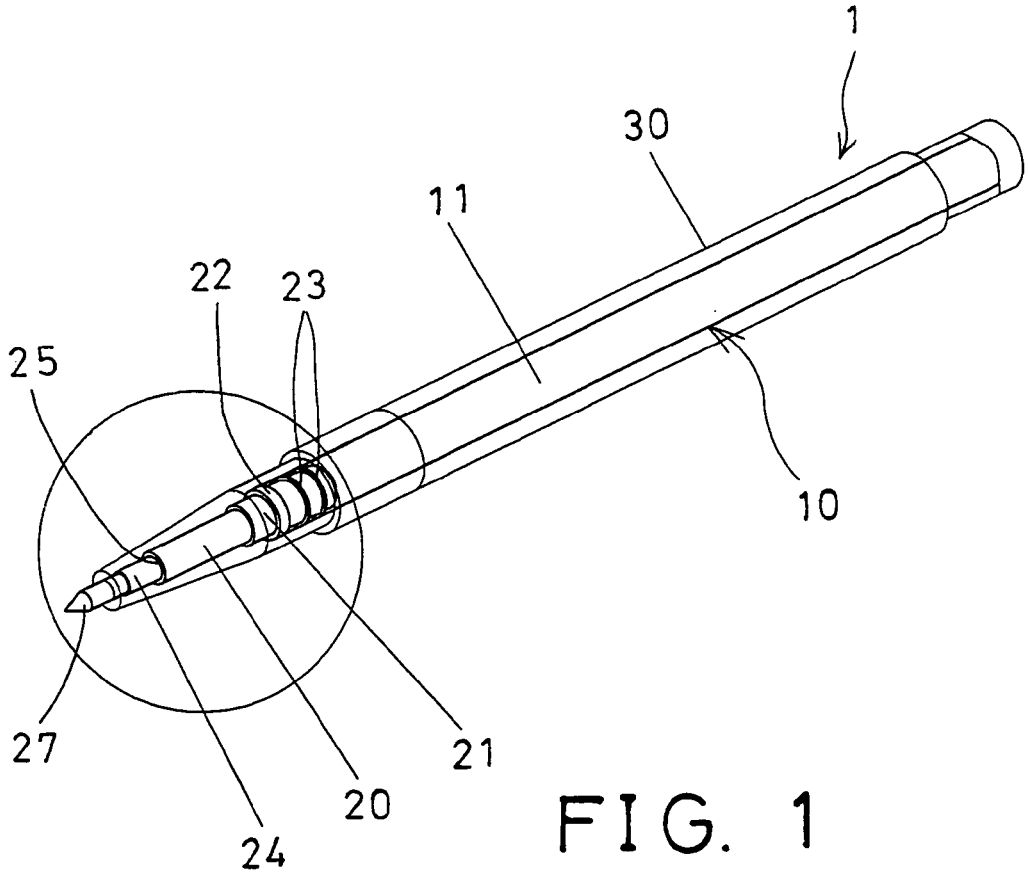
FIG. 1 is a perspective view illustrating a pen having an ink reservoir in accordance with the present invention selectively received therein.
Figure 2:
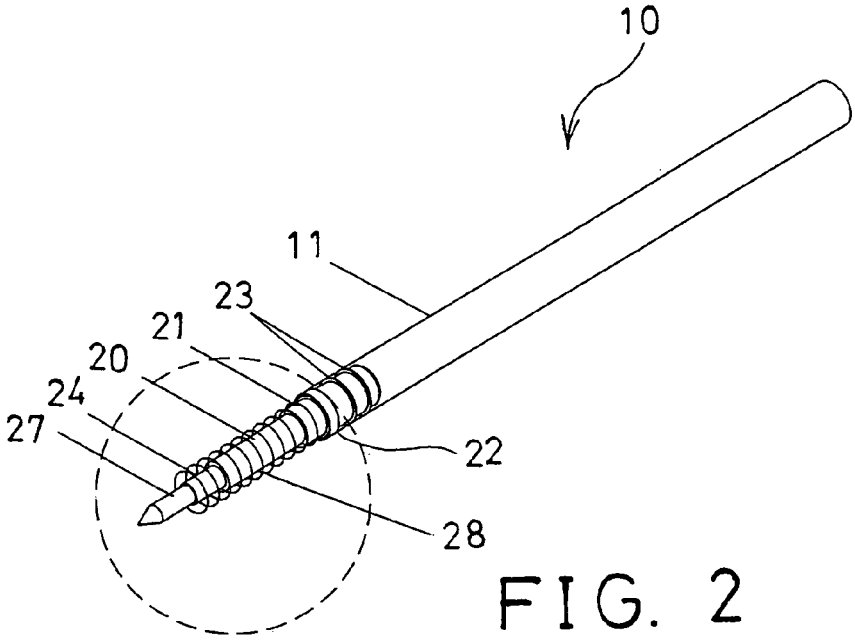
FIG. 2 is a perspective view of the ink reservoir.

In operation, as shown in FIGS. 1 and 1A, the tube 24 includes an outer diameter large enough for engaging with the housing 30, and for preventing the tube 24 from being completely engaged through the front opening 31 of the housing 30 (FIG. 1A), and thus to allow the ink reservoir 10 to be stably retained in the housing 30.

As shown in FIGS. 2–5, 5A–5D, 6, 6A–6D, 7 and 7A–7D, a spring member 28 may further be provided and engaged onto the barrel 20, and engageable with the peripheral rib 22 of the barrel 20, for applying a spring biasing force against the barrel 20, without forming the typical nips on the cartridge 11.

Figure 7C:
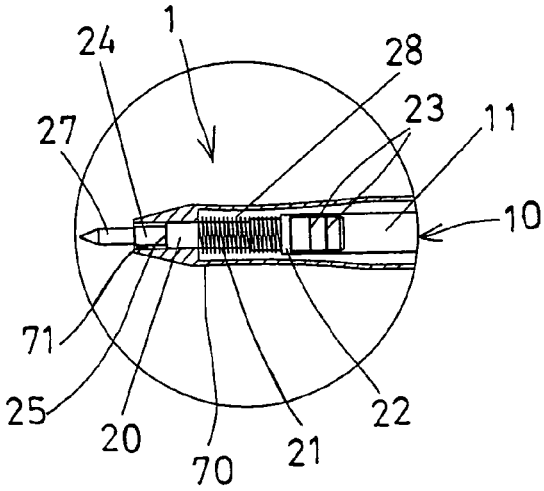
FIGS. 7C, 7D are partial cross sectional views illustrating the attachment of the ink reservoir to the pens as shown in FIGS. 7A and 7B respectively.
Figure 7A:
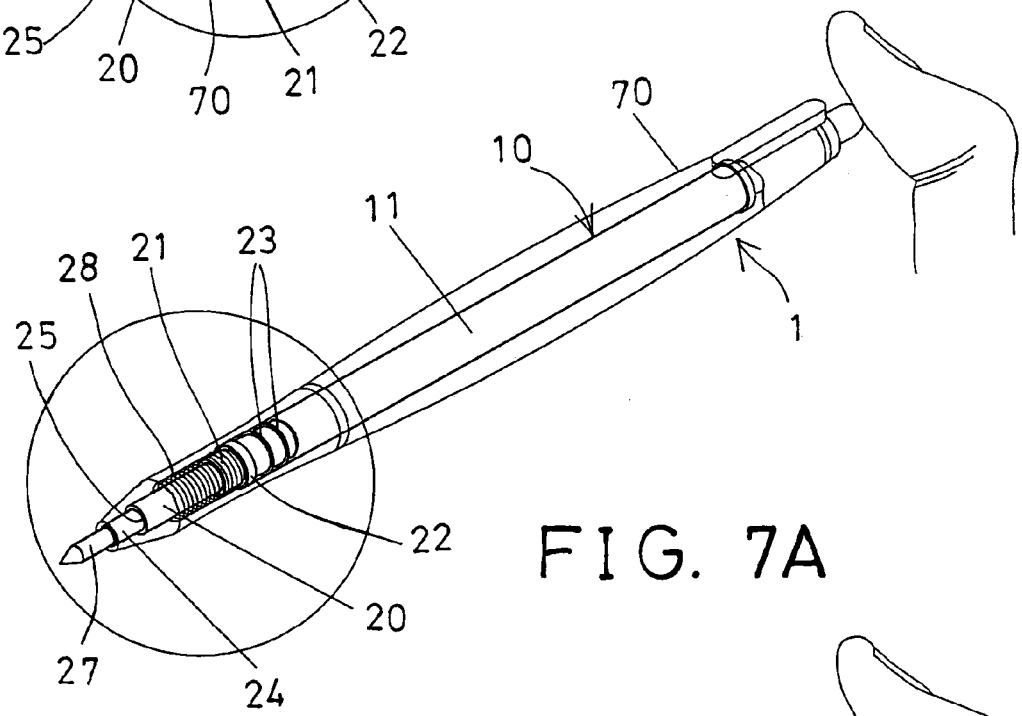
FIGS. 7A, 7B are perspective views illustrating the operation of the ink reservoir in the pen as shown in FIG. 7.
Figure 7:
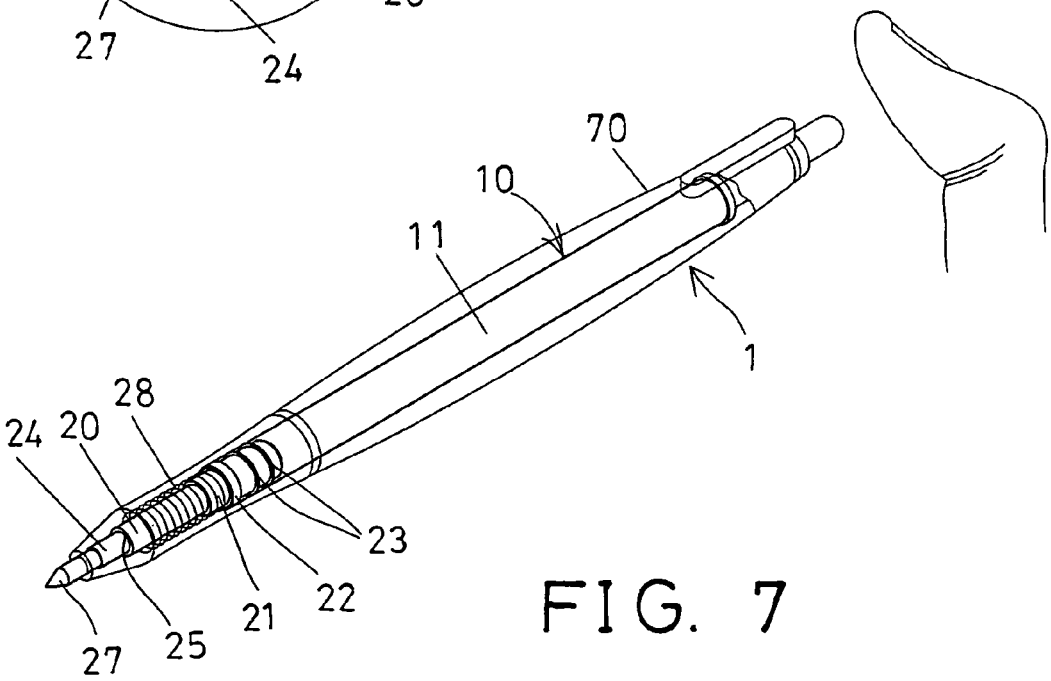
FIG. 7 is a further perspective view similar to FIGS. 1, 5 and 6, illustrating the further pen having the ink reservoir selectively or changeably received therein.
Figure 7D:
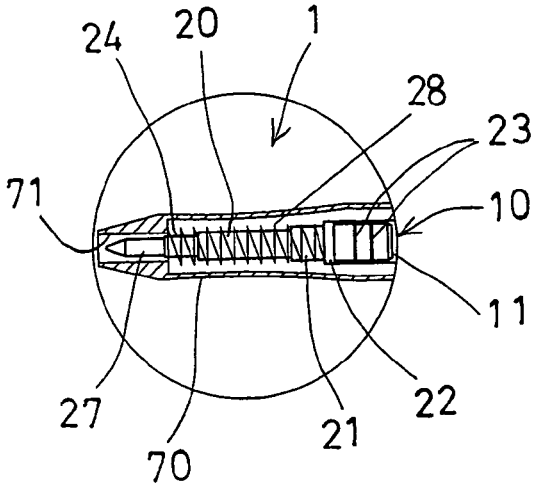
Figure 7B:
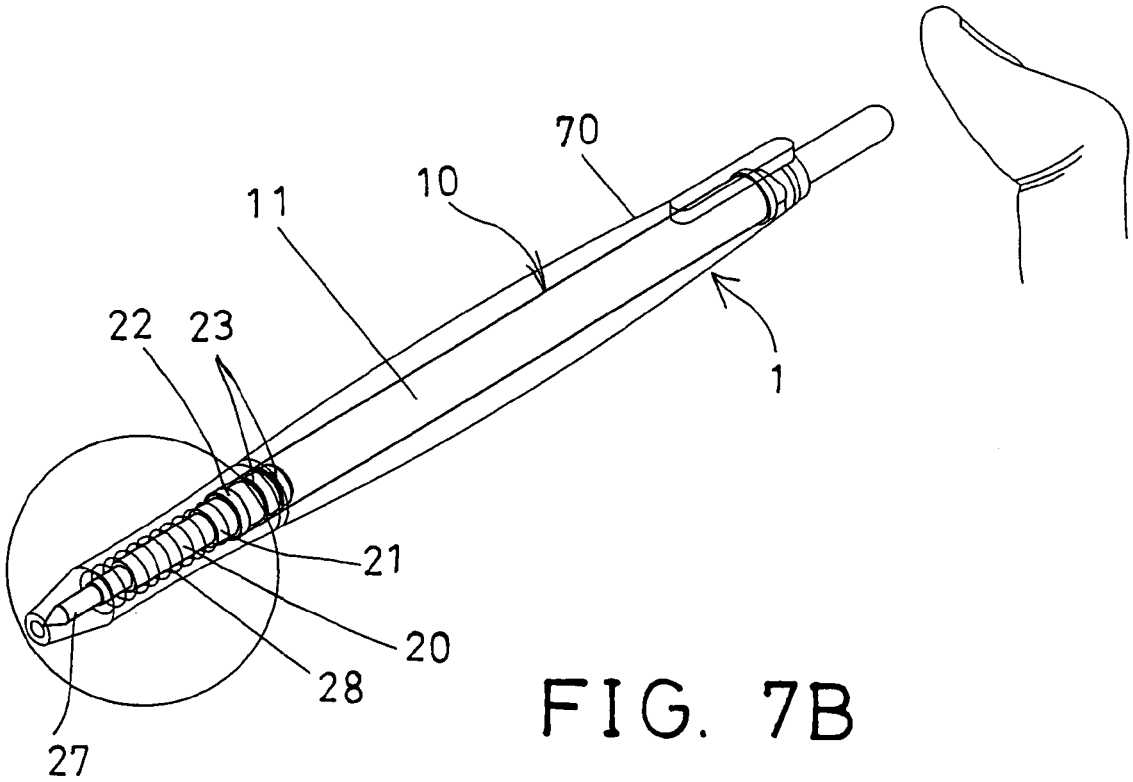

In addition, the spring member 28 may also be engaged between the housing 50, 60, 70 and the peripheral rib 22 of the barrel 20 when the housings 50, 60, 70 include front openings 51, 61, 71 of different configurations formed therein. For example, the housing 50 may include a longer but narrower front opening 51 (FIGS. 5C, 5D), the other housing 60 may include a longer and wider front opening 61 (FIGS. 6C, 6D), and the further housing 70 may include a shorter and narrower front opening 71 (FIGS. 7C, 7D).

The front openings 51, 61, 71 of the housing 50, 60, 70 are arranged to slidably receive the tube 24 and the barrel 20, but not the peripheral swelling 21 of the barrel 20. The barrel 20 may also be arranged to engage with the housing 70 (FIG. 7C), and thus to limit the movement of the ink reservoir 10 relative to the housing 70.

As shown in FIGS. 1, 5, 5A–5B, 6, 6A–6B, 7 and 7A–7B, the cartridge 11 may be cut to different lengths, for allowing the cartridge 11 of the ink reservoir 10 to be accommodated into the housings 30, 50, 60, 70 of different lengths. Without the provision of the barrel 20 between the cartridge 11 and the nib 27, the cartridge 11 of the ink reservoir 10 may not be accommodated into the housings 30, 50, 60, 70 of different lengths and of different configurations even when the cartridge 11 is cut to different lengths.

Accordingly, the ink reservoir in accordance with the present invention includes a structure for attaching to various pens of different configurations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pen comprising:

a housing including a front opening formed therein, and an ink reservoir including:

a cartridge received in said housing, and provided for receiving ink therein;

a peripheral swelling having an outer diameter approximately equal to an inner diameter of the cartridge so that in assembly state, the peripheral swelling is engaged to an inner side of the cartridge;

at least one sealing ring enclosing the peripheral swelling to prevent ink from flowing out through a gap defined between the peripheral swelling and the cartridge;

a peripheral rib extended radially and outwardly from the peripheral swelling to engage with said cartridge and to limit an engagement of said peripheral swelling relative to the cartridge, and to prevent said peripheral swelling from being over engaged into said cartridge;

a barrel having an outer diameter approximately equal to an inner diameter of the peripheral swelling so that in assembly state, the barrel is engaged to an inner side of the peripheral swelling;

a tube having an outer diameter approximately equal to an inner diameter of the barrel so that in assembly state, the tube is engaged to an inner side of the barrel;

a nib having a reduced rear end; an outer diameter of the reduced inner side of the nib being approximately equal to an inner diameter of the tube so that in assembly state, a rear side of the nib is engaged to an inner side of the tube.

2. The pen as claimed in claim 1 further comprising a spring member engaged between said housing and said barrel, to apply a spring biasing force against said barrel of said ink reservoir.

* * * * *